US008009102B2

(12) United States Patent
Kim et al.

(10) Patent No.: US 8,009,102 B2
(45) Date of Patent: Aug. 30, 2011

(54) MULTI-BAND ANTENNA AND MULTI-BAND ANTENNA SYSTEM WITH ENHANCED ISOLATION CHARACTERISTIC

(75) Inventors: Il-kyu Kim, Seongnam-si (KR); Chang-won Jung, Hwaseong-si (KR); Young-eil Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 573 days.

(21) Appl. No.: 12/105,614

(22) Filed: Apr. 18, 2008

(65) Prior Publication Data

US 2009/0079655 A1 Mar. 26, 2009

(30) Foreign Application Priority Data

Sep. 21, 2007 (KR) ..... 10-2007-0096985

(51) Int. Cl.
*H01Q 1/24* (2006.01)

(52) U.S. Cl. ..... 343/700 MS; 343/702; 343/846

(58) Field of Classification Search ..... None
See application file for complete search history.

(56) References Cited

U.S. PATENT DOCUMENTS

| | | | | |
|---|---|---|---|---|
| 6,476,769 | B1 * | 11/2002 | Lehtola | 343/702 |
| 6,791,498 | B2 * | 9/2004 | Boyle et al. | 343/702 |
| 7,109,923 | B2 * | 9/2006 | Ollikainen et al. | 343/700 MS |
| 7,439,916 | B2 * | 10/2008 | Wang et al. | 343/700 MS |
| 7,482,984 | B2 * | 1/2009 | Rosengren et al. | 343/702 |
| 7,782,261 | B2 * | 8/2010 | An et al. | 343/702 |
| 2004/0130494 | A1 * | 7/2004 | Fukushima et al. | 343/702 |
| 2007/0285334 | A1 * | 12/2007 | Tsutsumi et al. | 343/893 |
| 2008/0068273 | A1 * | 3/2008 | Schneider et al. | 343/742 |

* cited by examiner

*Primary Examiner* — Trinh V Dinh
(74) *Attorney, Agent, or Firm* — NSIP Law, PC

(57) ABSTRACT

A Multi-Band antenna system includes an antenna which resonates in a plurality of frequency bands and a controller which drives the antenna. The antenna includes a ground plate and a plurality of radiators which are formed on both sides of the ground plate in directions perpendicular to a surface of the ground plate in a space at an edge of the ground plate, wherein each radiator is connected to the edge of the ground plate.

16 Claims, 10 Drawing Sheets

MULTI-BAND ANTENNA AND MULTI-BAND ANTENNA SYSTEM WITH ENHANCED ISOLATION CHARACTERISTIC

CROSS-REFERENCE TO RELATED APPLICATIONS

This application claims the benefit under 35 U.S.C. §119 (a) of a Korean Patent Application No. 10-2007-0096985, filed on Sep. 21, 2007, in the Korean Intellectual Property Office, the disclosure of which is incorporated herein by reference in its entirety.

TECHNICAL FIELD

The following description relates to a Multi-Band antenna and a Multi-Band antenna system, and more particularly, to a Multi-Band antenna in which a plurality of radiators have a symmetrical arrangement centered on a ground plate and a Multi-Band antenna system using the Multi-Band antenna.

BACKGROUND

Generally, antennas are devices which convert electric signals into electromagnetic waves and radiate the electromagnetic waves through air and vice versa. Patterns of effective areas onto or from which antennas can radiate or sense electromagnetic waves are generally referred to as radiation patterns.

In recent years, antennas having a very wide frequency band comprising a plurality of service bands or multi-band antennas operated in double or multiple frequency bands have been developed.

A plurality of antennas in a Multi-Band antenna are disposed on one side of a ground plate, causing interference to occur between the antennas. Thus, radiation patterns may be distorted or antenna elements may be combined with one another.

In a Multi-Band antenna system employing a monopole antenna, a radiation strip is folded a plurality of times so that the monopole antenna may be operated in multiple frequency bands.

As the number of folds of the radiation strip increases, the system may become complicated and the size of the antenna may increases. Accordingly, there is a need to efficiently arrange antennas in a Multi-Band antenna system, so that the antennas may be operated in multiple frequency bands, interference between antennas may be reduced, and the antennas may be fabricated to be small in size.

SUMMARY

In one general aspect, there is provided a Multi-Band antenna and a Multi-Band antenna system using the Multi-Band antenna in which a plurality of radiators have a symmetrical arrangement centered on a ground plate of the Multi-Band antenna.

In another general aspect, a Multi-Band antenna includes a ground plate; and a plurality of radiators which are formed on both sides of the ground plate in directions perpendicular to a surface of the ground plate in a space at an edge of the ground plate, each radiator being connected to the edge of the ground plate.

The radiators may be disposed such that electromagnetic waves radiated from the radiators are orthogonally polarized.

Each of the plurality of radiators may comprise a radiation plate disposed parallel to a surface of the ground plate; a radiation strip disposed on one side of the radiation plate so that a gap at regular intervals is formed between the radiation strip and the radiation plate; and a line connector which extends from the edge of the ground plate in a direction perpendicular to the surface of the ground plate, and is connected to the radiation strip.

Each of the plurality of radiators may further comprise a connector which is disposed in the gap between the radiation plate and the radiation strip and connects the radiation plate to the radiation strip.

The radiation plate may have a polygonal shape. The radiation strip may be disposed along each side of the radiation plate and may be folded at vertices of the radiation plate to form a gap between the radiation plate and the radiation strip.

The radiation strip may be inclined at approximately 45° to a plane perpendicular to the edge of the ground plate.

The radiation plates of the plurality of radiators may not face each other.

In still another general aspect, an antenna includes a ground unit and a first radiator formed on the ground unit, a second radiator formed on the ground unit having a radiation plate disposed parallel to a surface of the ground unit and a radiation strip disposed on a side of the radiation plate. The second radiator may further comprise a line connector which extends from an edge of the ground plate in a direction perpendicular to the surface of the ground plate, and is connected to the radiation strip. The first and second radiators may be of different size.

In a further general aspect, a Multi-Band antenna system includes an antenna which resonates in a plurality of frequency bands, the antenna comprising a plurality of radiators; and a controller which drives the antenna. The plurality of radiators may be formed on both sides of a ground plate in directions perpendicular to a surface of the ground plate in a space at an edge of the ground plate, and each radiator may be connected to the edge of the ground plate.

The controller may control an electric current applied to the plurality of radiators to flow in opposite directions.

Each of the plurality of radiators may comprise a radiation plate disposed in parallel to a surface of the ground plate; a radiation strip disposed on one side of the radiation plate so that a gap is formed at regular intervals between the radiation strip and the radiation plate; a line connector which extends from the edge of the ground plate in a direction perpendicular to the surface of the ground plate, and is connected to the radiation strip; and a connector which is disposed in the gap between the radiation plate and the radiation strip.

According to a control of the controller, the antenna may be caused to resonate in a first frequency band by the radiation strip and the radiation plate, to resonate in a second frequency band by the radiation plate, and to resonate in a third frequency band by coupling produced in the gap between the radiation plate and the radiation strip.

According to a control of the controller, the plurality of radiators may be caused to alternately resonate.

Other features will become apparent to those skilled in the art from the following detailed description, which, taken in conjunction with the attached drawings, discloses exemplary embodiments of the invention.

BRIEF DESCRIPTION OF THE DRAWINGS

Throughout the drawings and the detailed description, the same drawing reference numerals will be understood to refer to the same elements, features, and structures.

DETAILED DESCRIPTION

The following detailed description is provided to assist the reader in gaining a comprehensive understanding of the methods and systems described herein. According, various changes, modifications, and equivalents of the systems and methods described herein will be suggested to those of ordinary skill in the art. Also, description of well-known functions and constructions are omitted to increase clarity and conciseness.

Figure 1:
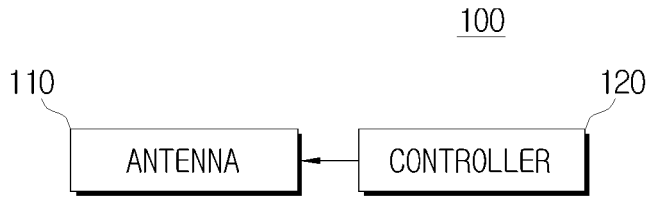
FIG. 1 is a block diagram illustrating an exemplary Multi-Band antenna system.

FIG. 1 illustrates an exemplary Multi-Band antenna system. As illustrated FIG. 1, the Multi-Band antenna system 100 comprises an antenna 110 and a controller 120.

The antenna 110 may comprise a plurality of radiators, and resonates in a plurality of frequency bands. Each of the plurality of radiators may be a monopole antenna. An exemplary configuration of the antenna 110 will be described in detail with reference to FIGS. 2 and 3.

Figure 2:
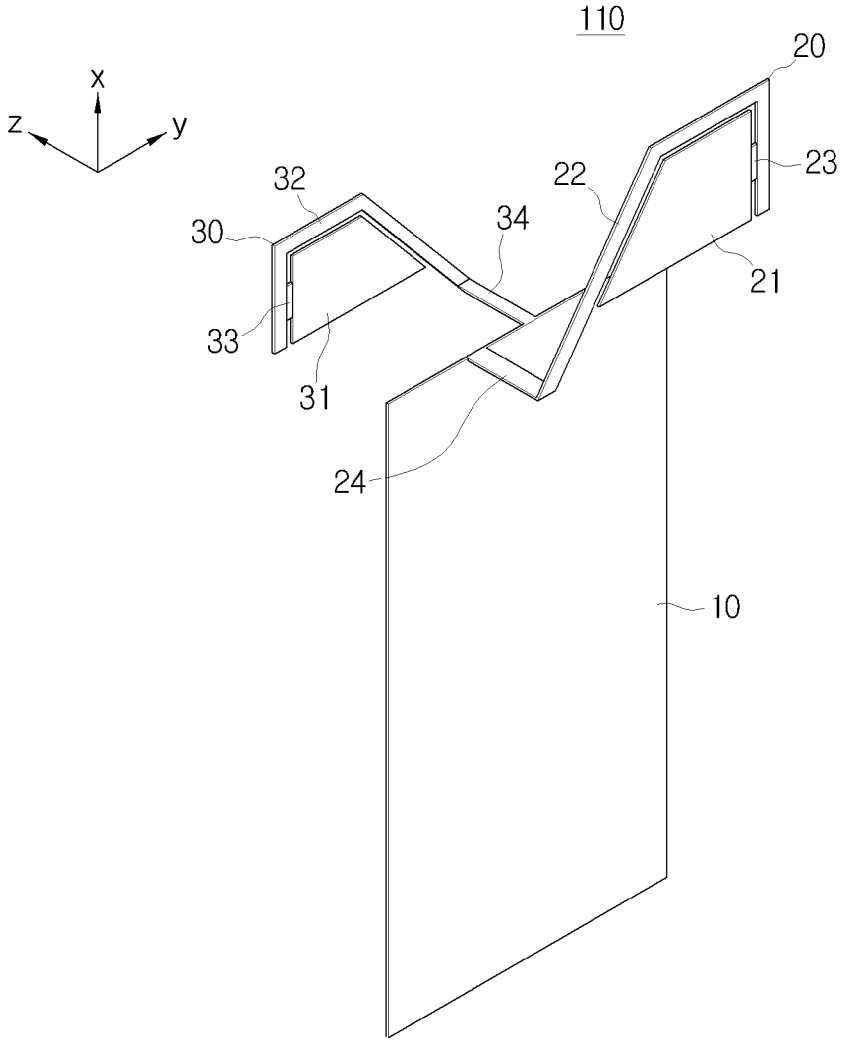
FIG. 2 is a first plane view of the exemplary Multi-Band antenna shown in FIG. 1.

FIG. 2 illustrates the antenna 110 of FIG. 1. As shown in FIG. 2, the antenna 110 is configured in such a manner that a first radiator 20 is connected to a second radiator 30 via a ground plate 10.

The first radiator 20 and the second radiator 30 may be formed on respective sides of the ground plate 10 in directions perpendicular to a surface of the ground plate 10, that is, in a ZY plane of the ground plate 10, in a space at an edge of the ground plate 10. Here, the first radiator 20 and the second radiator 30 may be connected to the edge of the ground plate 10.

The first radiator 20 comprises a first radiation plate 21, a first radiation strip 22, a first connector 23, and a first line connector 24. The second radiator 30 comprises a second radiation plate 31, a second radiation strip 32, a second connector 33, and a second line connector 34.

The first radiation plate 21 is disposed in parallel to a surface of the ground plate 10, that is, in parallel to a XY plane of the ground plate 10. The first radiation strip 22 is disposed at one side of the first radiation plate 21 so that gaps may be formed at regular intervals between the first radiation plate 21 and the first radiation strip 22. The first connector 23 is disposed in the gap between the first radiation plate 21 and the first radiation strip 22, and may connect the first radiation plate 21 to the first radiation strip 22.

The first radiation strip 22 may be connected to one side of the edge of the ground plate 10 through the first line connector 24. Here, the first line connector 24 may extend from the edge of the ground plate 10 in a direction perpendicular to a surface of the ground plate 10, that is, perpendicular to the XY plane of the ground plate 10, and may be connected to the first radiation strip 22. The second radiator 30 may be configured in the same manner as the first radiator 20.

The radiation plates 21 and 31 may have a substantially polygonal shape. The radiation strips 22 and 32 may be disposed along each side of the respective radiation plates 21 and 31, and may be bent at vertices of the radiation plates 21 and 31. A gap may be formed between each of the first and second radiation plates 21 and 22 and the respective radiation strips 22 and 32.

Figure 3:
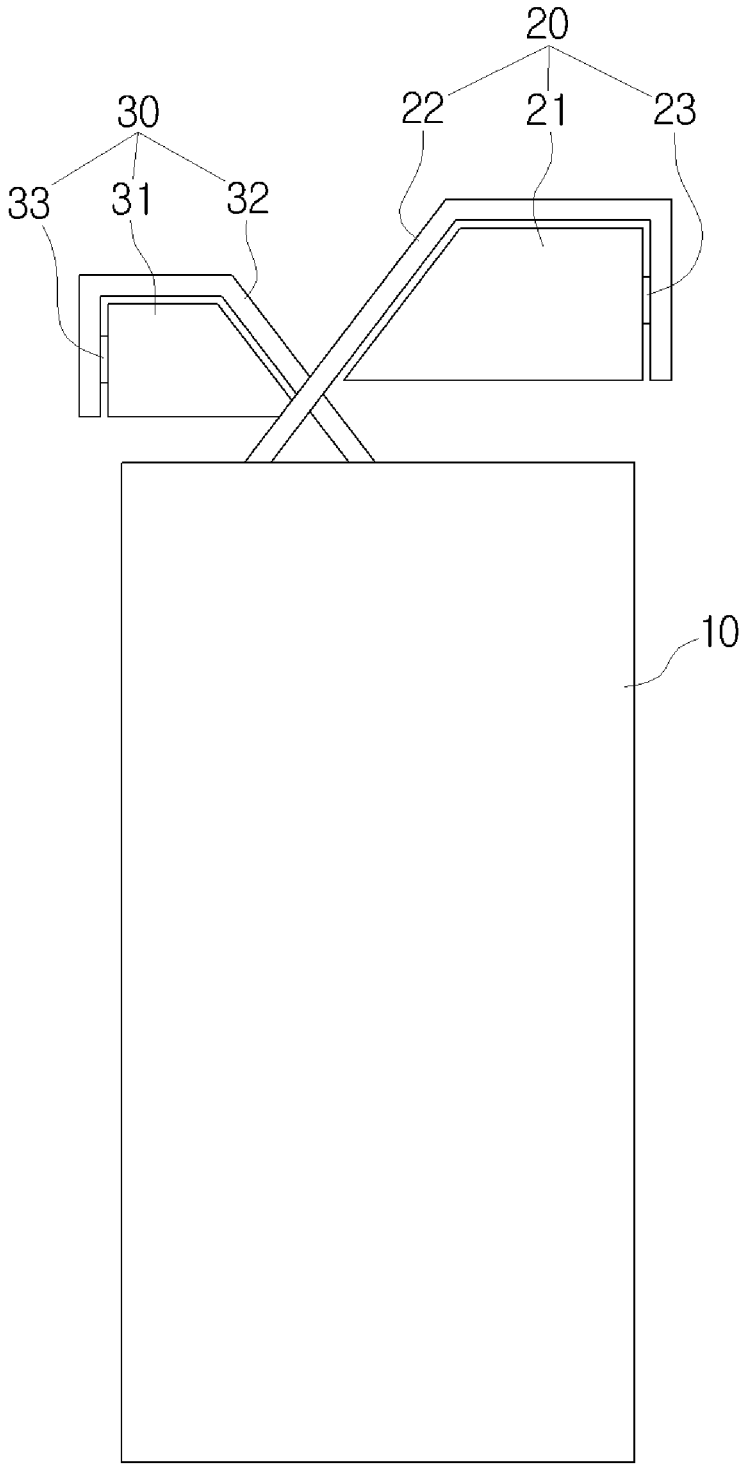
FIG. 3 is a second plane view of the Multi-Band antenna shown in FIG. 1.

FIG. 3 illustrates another view of the Multi-Band antenna 110 of FIG. 1. As illustrated in FIG. 3, the first radiator 20 and the second radiator 30 have a symmetrical arrangement centered on the ground plate 10. Additionally, the first radiation plate 21 and the second radiation plate 31 do not face each other, so each of the radiators 20 and 30 may individually operate to increase resonance and prevent pattern distortion.

With reference to FIG. 1, the controller 120 may apply an electric current to the first radiator 20 and the second radiator 30 to control electromagnetic waves to be radiated at a predetermined resonant frequency. The controller 120 may apply the electric current to the first radiator 20 and the second radiator 30 so that the electric current flows therefrom in opposite directions.

The electric current applied to the first radiator 20 may flow sequentially in the order of the first line connector 24, first radiation strip 22, first connector 23, and first radiation plate 21. The electric current applied to the second radiator 30 may flow sequentially in the order of the second line connector 34, second radiation strip 32, second connector 33, and second radiation plate 31.

The first radiation strip 22 and the second radiation strip 32 may be disposed such that the electric current applied to the first radiation strip 22 and the electric current applied to the second radiation strip 32 may flow in orthogonal directions, that is, such that the electromagnetic waves radiated from each radiator may be orthogonally polarized. Accordingly, it is possible to increase isolation between the first radiator 20 and the second radiator 30.

Figure 4:
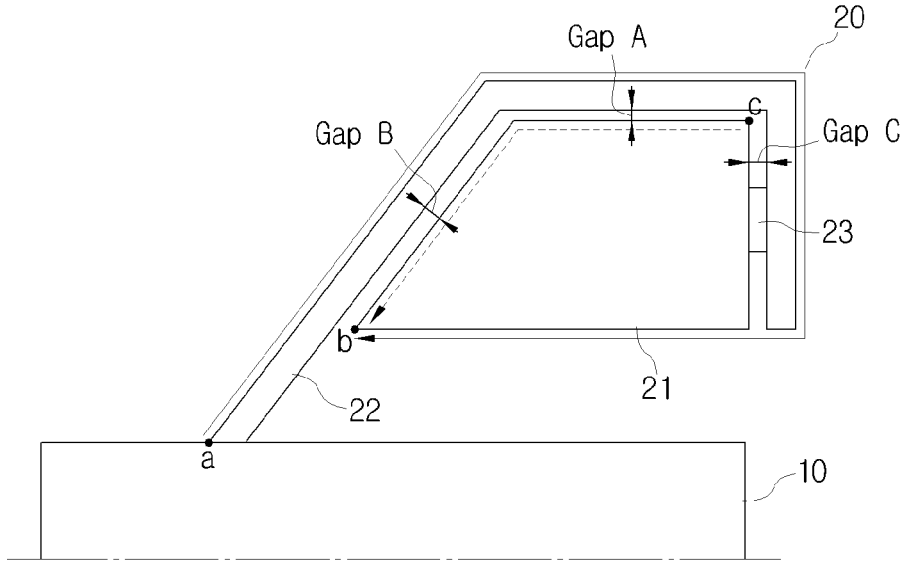
FIG. 4 is a configuration diagram illustrating an exemplary first radiator shown in FIG. 3.

FIG. 4 illustrates an exemplary first radiator 20 shown in FIG. 3. In FIG. 4, Gap A, Gap B and Gap C may be formed between the first radiation plate 21 and the first radiation strip 22. Here, widths of the gaps may be tuned to a specific frequency.

Gap B, which is formed between the first radiation plate 21 and an inclined portion of the first radiation strip 22, may have a width equal to Gap C, which is determined according to a width of the first connector 23. Gap A, which is formed between the first radiation plate 21 and a portion of the first radiation strip 22 which faces the first radiation plate 21, may have a width less than Gap B or Gap C.

Where the width of Gap A in the first radiator 20 shown in FIG. 4 becomes narrower, the resonant frequency band may become wider, and it is possible to accurately tune to a resonance point.

The controller 120 may feed a high frequency signal to the first radiator 20, and control the electromagnetic waves to be radiated at a certain frequency. Where the controller 120 applies the electric current to the first radiator 20, the first radiator 20 may resonate in a certain frequency band based on lengths of the first radiation plate 21 and the first radiation strip 22, and the gap between the first radiation plate 21 and the first radiation strip 22.

In this case, a first resonant frequency may be determined based on the length from a first point a, at which feeding of the first radiator is initiated, to a third point c, which is one of the vertices of the first radiation plate 21 and which corresponds to the inclined portion of the first radiation strip 22. A second resonant frequency may be determined based on the length from a second point b, which is another vertex of the first radiation plate 21, to the third point c. Furthermore, a third resonant frequency may be determined by coupling produced in the gap between the first radiation plate 21 and the first radiation strip 22.

The first, second and third resonant frequencies may be approximately 0.9 GHz, 2.4 GHz, and 5.5 GHz. A return loss caused by resonance of the exemplary first radiator 20 will be described with reference to FIG. 5.

Figure 5:
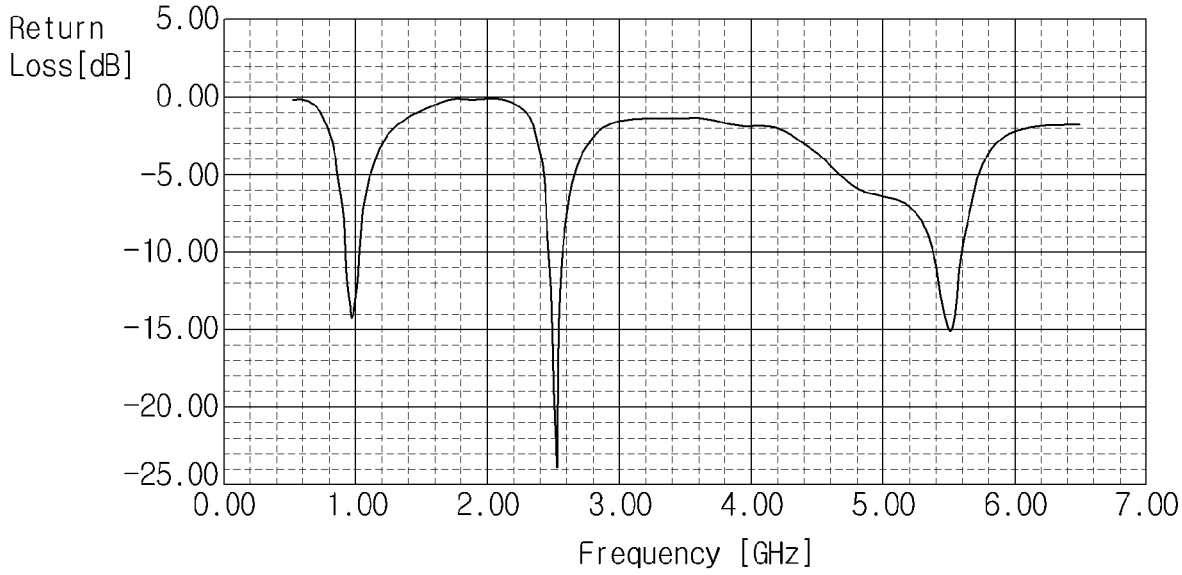
FIG. 5 is a graph illustrating a return loss in the first radiator shown in FIG. 4.

FIG. 5 illustrates a return loss of the first radiator 20 shown in FIG. 4. As shown in FIG. 5, the first radiator 20 may resonate in the first, second and third resonant frequencies, which may be approximately 0.9 GHz, 2.4 GHz, and 5.5 GHz respectively.

Figure 6:
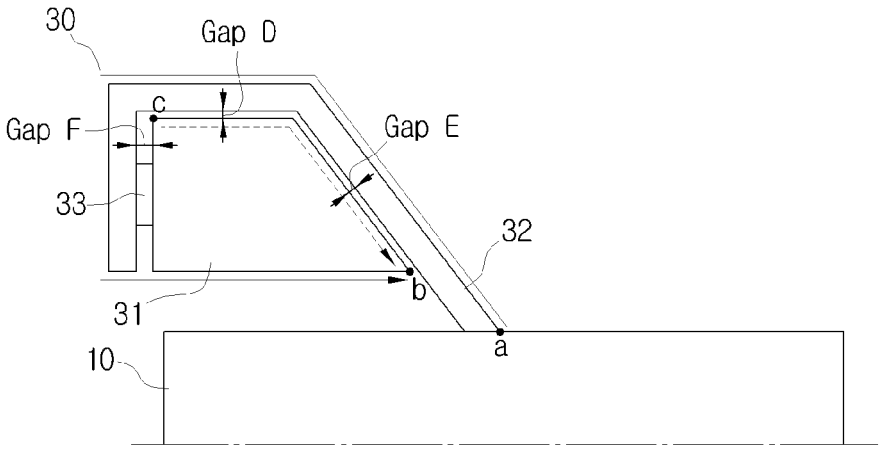
FIG. 6 is a configuration diagram illustrating an exemplary second radiator shown in FIG. 3.

FIG. 6 illustrates an exemplary second radiator 30 shown in FIG. 3. Here, the second radiator 30 is configured in the same manner as the first radiator 20. Accordingly, a detailed description thereof is omitted. The second radiator 30 may be smaller in size than the first radiator 20.

As shown in FIG. 6, Gap D, Gap E and Gap F may be formed between the second radiation plate 31 and the second radiation strip 32. Here, the widths of the gaps may be tuned to a certain frequency.

Gap E formed between the second radiation plate 31 and an inclined portion of the second radiation strip 32, and Gap D formed between the second radiation plate 31 and a portion of the second radiation strip 32 which faces the second radiation plate 31 may desirably have widths less than Gap B of the first radiator 20. Gap F may have a width equal to Gap C of the first radiator 20.

The first, second and third resonant frequencies of the second radiator 30 may be approximately 1.7 GHz, 3.4 GHz, and 7 GHz. The second radiator 30 may resonate in only the first resonant frequency and the second resonant frequency. A return loss caused by resonance of the exemplary second radiator 30 will be described with reference to FIG. 7.

The antenna 110 may operate in five frequency bands using the two radiators each folded once.

The controller 120 may control the first radiator 20 and the second radiator 30 to resonate alternately. Specifically, the controller 120 may control the first radiator 20 and the second radiator 30 to resonate in the order of approximately 0.9 GHz, 1.7 GHz, 2.4 GHz, 3.4 GHz, and 5.5 GHz of the resonant frequency bands. The two radiators may be individually operated by reducing mutual coupling therebetween.

Figure 7:
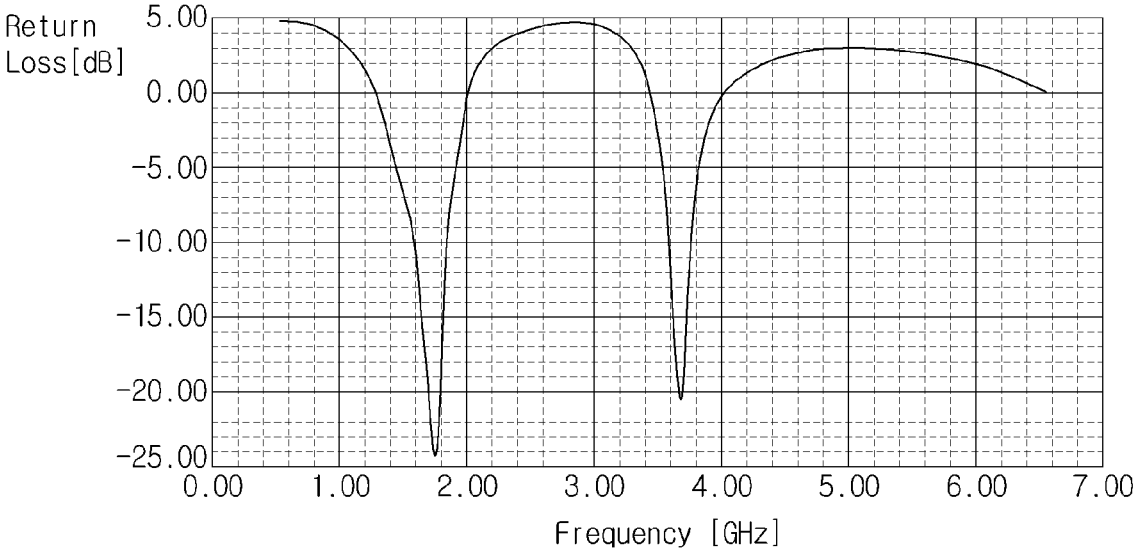
FIG. 7 is a graph illustrating a return loss in the second radiator shown in FIG. 6.

FIG. 7 illustrates a return loss of the second radiator 30 shown in FIG. 6. In FIG. 7, the second radiator 30 may resonate in the first resonant frequency and second resonant frequency, which may be approximately 1.7 GHz and 3.4 GHz.

The antenna 10 may be configured in such a manner that the first radiator 20 and the second radiator 30 are formed on respective sides of the ground plate 10 in directions perpendicular to a surface of the ground plate 10 in a space at an edge of the ground plate 10, and thus isolation may be improved.

A return loss of the exemplary antenna 110 was compared with a return loss of a conventional antenna in which radiators are formed on one side of a ground plate.

Figure 8:
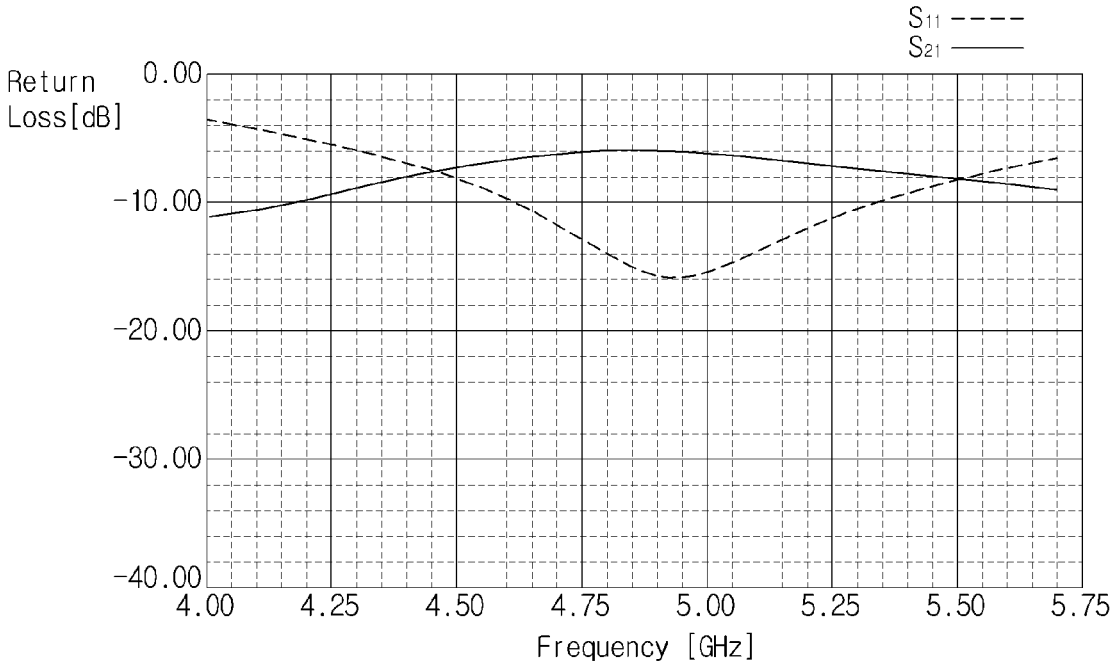
FIG. 8 is a graph illustrating a return loss in a conventional Multi-Band antenna comprising a plurality of radiators arrayed on one side of a ground plate.

FIG. 8 illustrates a return loss in a conventional Multi-Band antenna (not shown) comprising a plurality of antennas arrayed on one side of a ground plate. On a line graph S11 of FIG. 8, a monopole antenna may operate within approximately 4.6 GHz to 5.3 GHz frequency bands at a return loss level of approximately −10 dB. Here, it was difficult to accurately tune to a resonance point.

On a line graph S21 of FIG. 8 which indicates isolation, the isolation level is in the range of approximately −5 dB to −10 dB. It was determined that the electric currents applied to a first radiator and a second radiator flow in the same direction, causing interference to occur between the radiators.

Figure 9:
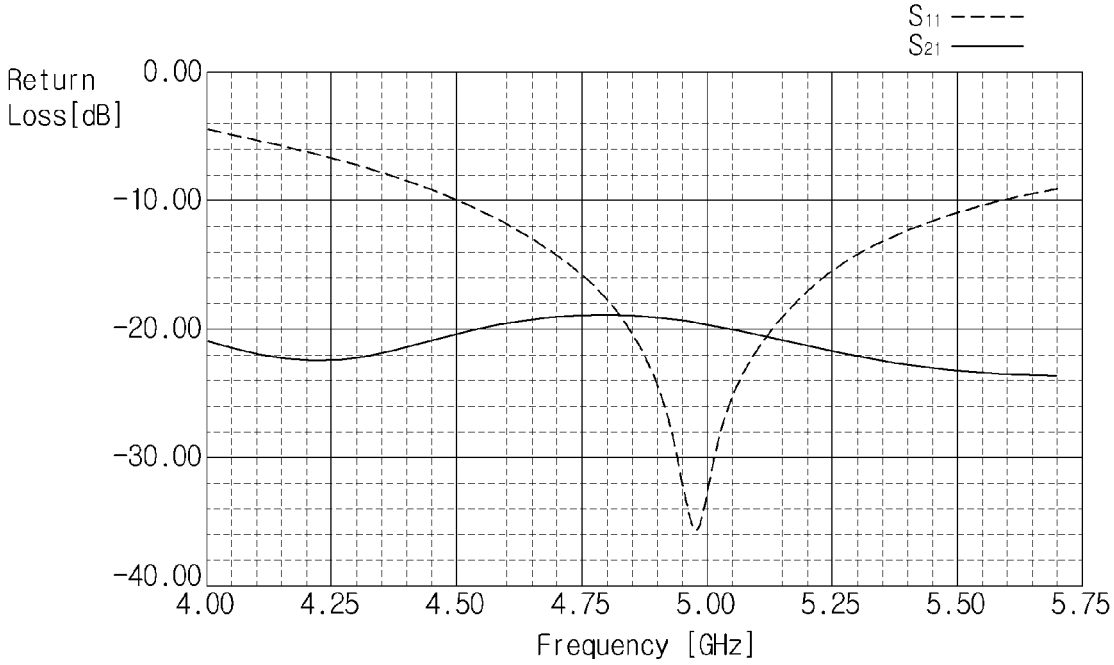
FIG. 9 is a graph illustrating a return loss in a Multi-Band antenna according to an exemplary embodiment.

FIG. 9 illustrates a return loss in a Multi-Band antenna according to an exemplary embodiment. Here, the MULTI-BAND antenna is configured as shown in FIGS. 2 and 3, and the electric currents flow in opposite directions.

As represented by a dotted line graph S11 of FIG. 9, a monopole antenna may operate within approximately 4.5 GHz to 5.6 GHz frequency bands at a return loss level of approximately −10 dB. Accordingly, the Multi-Band antenna according to an exemplary embodiment may resonate at frequency bands wider than a conventional antenna. Additionally, resonance points may be more accurate than in a conventional antenna.

As indicated by a line graph S21 of FIG. 9 representing isolation, the Multi-Band antenna has a gain of approximately −20 dB. Accordingly, isolation is reduced by 10 dB or greater, and the depth of the resonance point is reduced by 6 dB or greater, compared to the conventional antenna. Therefore, isolation and mutual coupling is improved.

Figure 10:
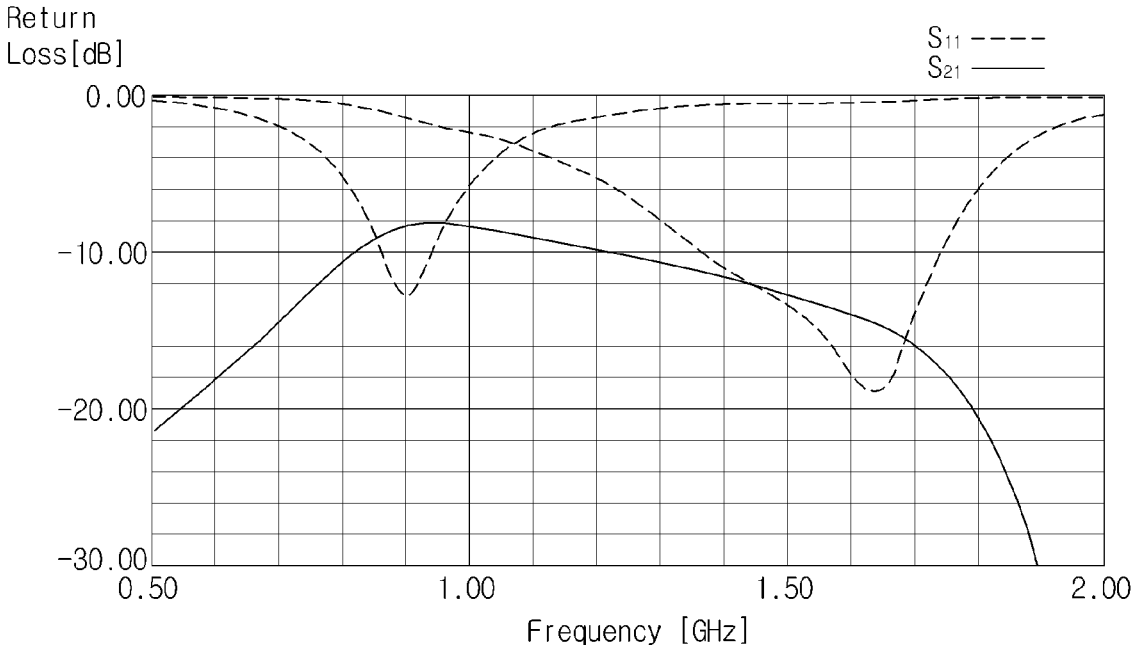
FIG. 10 is a graph illustrating a return loss in a Multi-Band antenna in a first arrangement according to an exemplary embodiment.
Figure 11:
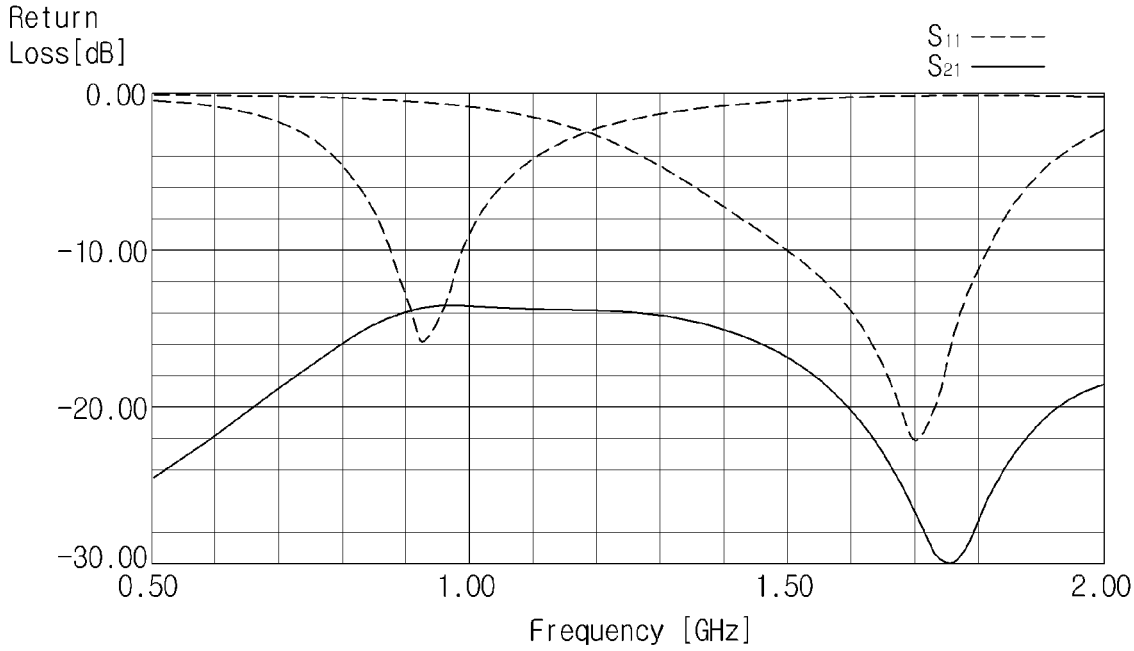
FIG. 11 is a graph illustrating a return loss in a Multi-Band antenna in a second arrangement according to another exemplary embodiment.

FIG. 10 illustrates a return loss of a Multi-Band antenna in a first arrangement, according to an exemplary embodiment. FIG. 11 illustrates a return loss of a Multi-Band antenna in a second arrangement, according to another exemplary embodiment. Here, FIGS. 10 and 11 are graphs showing a return loss of the second radiator 30 according to each arrangement of the radiators 20 and 30.

A first arrangement of the radiators 20 and 30 may refer to a configuration in which the first line connector 24 and second line connector 34 in which feeding is initiated are arranged at a terminal end of the ground plate 10.

A second arrangement of the radiators 20 and 30 may refer to a configuration in which the first radiation plate 21 and second radiation plate 31 are arranged so as not to face each other. With the second arrangement, isolation is improved compared to the first arrangement, as indicated by comparing the graphs shown in FIGS. 10 and 11.

By comparing the line graphs S21 of FIGS. 10 and 11, each of which representing isolation, it is shown that the isolation level in FIG. 11 is reduced by approximately 6 dB.

Figure 12:
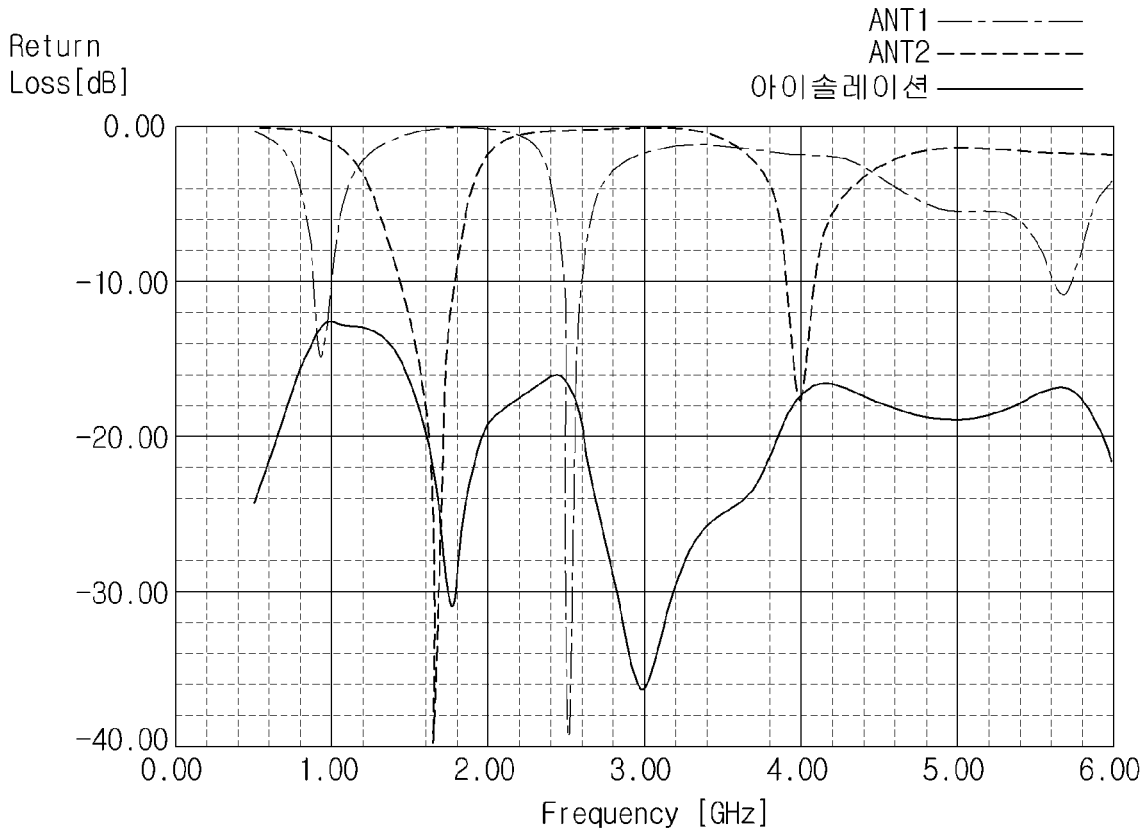
FIG. 12 is a graph illustrating a return loss in an antenna according to an exemplary embodiment.

FIG. 12 illustrates a return loss in the antenna 110 according to an exemplary embodiment. FIG. 12 shows the return loss of the antenna 110 configured as shown in FIGS. 2 and 3.

The antenna 110 is configured such that the first radiation plate 21 and the second radiation plate 31 do not face each other, and the electric currents applied to the first radiator 20 and the second radiator 30 flow in opposite directions. The radiation strips 22 and 32 are inclined at approximately 45° to the plane perpendicular to the edge of the ground plate 10.

The resonance points of the first radiator 20 may be approximately 0.9 GHz, 2.4 GHz and 5.5 GHz, and the resonance points of the second radiator 30 may be approximately 1.7 GHz and 3.4 GHz.

Referring to FIG. 12, an isolation level of −15 dB or greater may be exhibited at all frequency bands.

Figure 13A:
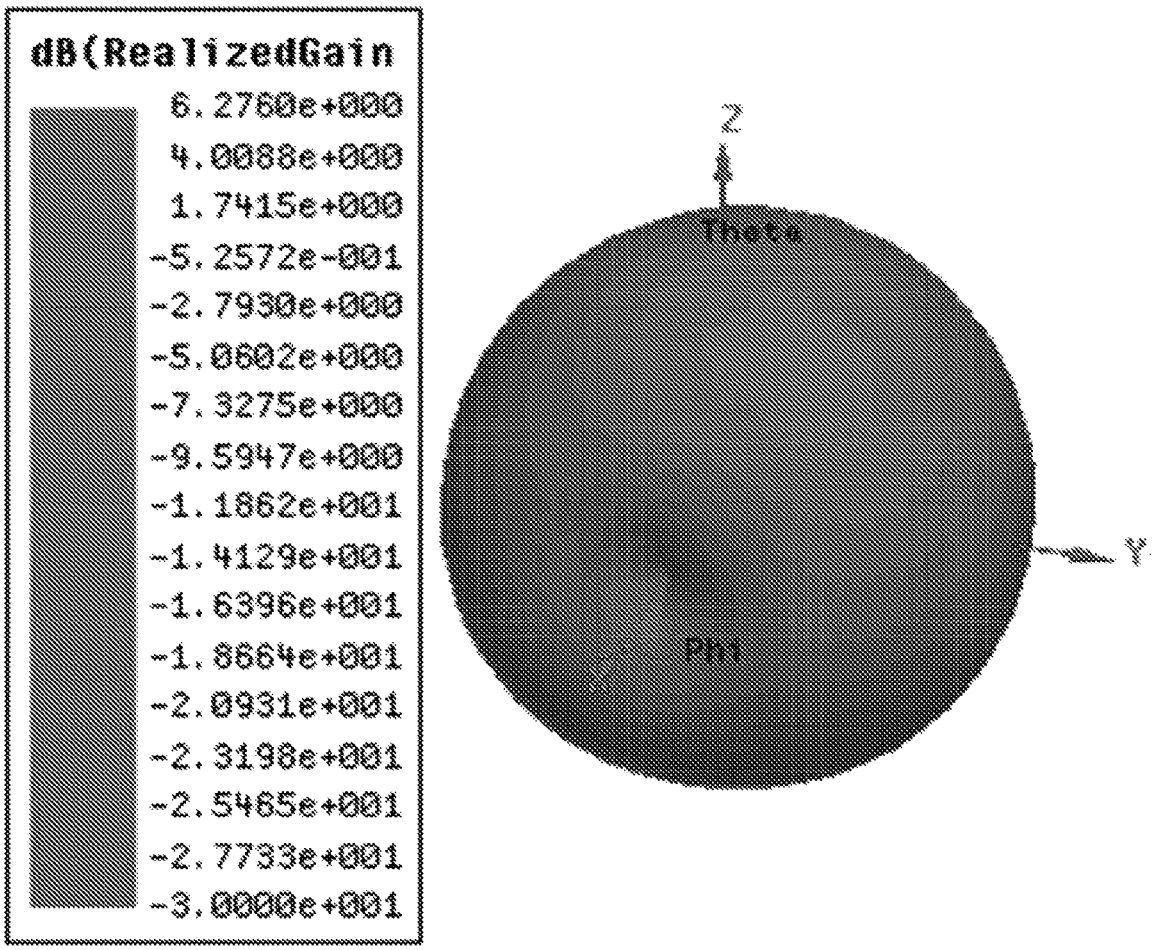
FIGS. 13A to 13C are graphs illustrating a beam patterns of an antenna in a bandwidth according to an exemplary embodiment.
Figure 13B:
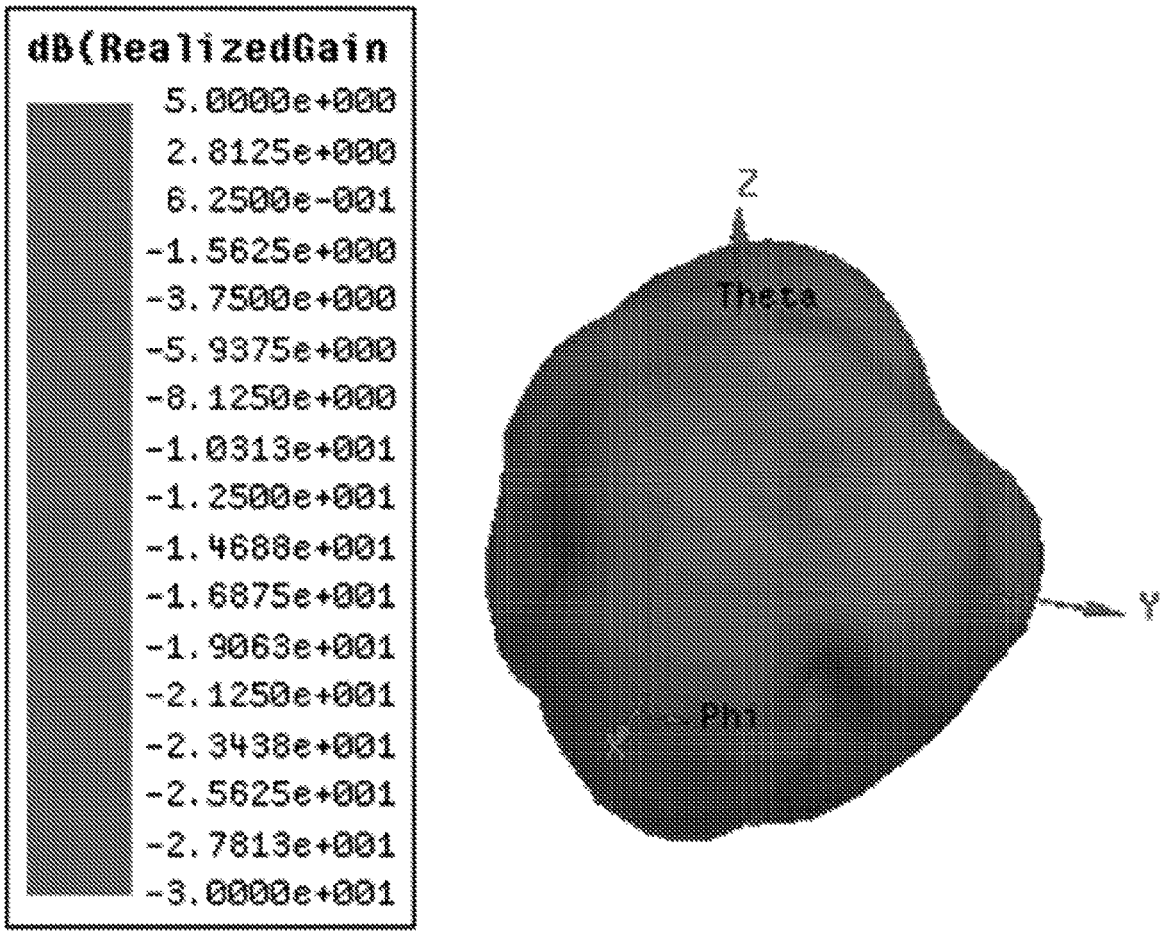
Figure 13C:
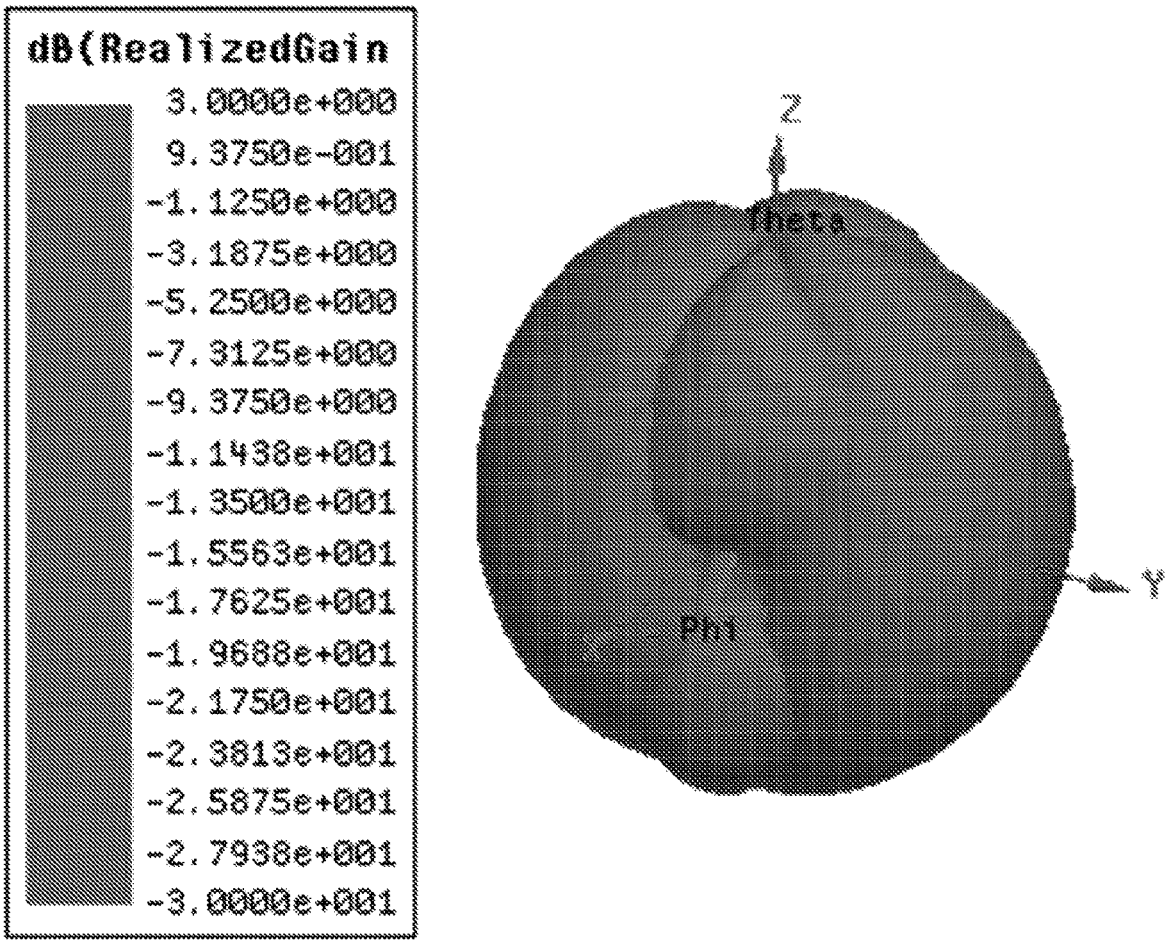

FIGS. 13A to 13C illustrate beam patterns of the antenna 110 in a bandwidth according to an exemplary embodiment. FIG. 13A shows a beam pattern of the antenna where the resonance point of the first radiator 20 is approximately 900 MHz, FIG. 13B shows a beam pattern of the antenna where the resonance point of the first radiator 20 is approximately 5.5 GHz, and FIG. 13C shows a beam pattern of the antenna where the resonance point of the second radiator 30 is approximately 3.4 GHz.

As shown in FIGS. 13A to 13C, it is possible to obtain a gain of 2 dBi or greater over the entire band according to the beam patterns of all directions.

As disclosed above, an antenna may resonate in multiple frequency bands by using a simple configuration. Additionally, radiators of an antenna may be individually operated so that isolation may be improved.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A Multi-Band antenna comprising:

a ground plate; and a plurality of radiators formed on opposing sides of the ground plate in directions perpendicular to a surface of the ground plate in a space at an edge of the ground plate, the plurality of radiators having a disposition which is above the ground plate, each of the plurality of radiators being connected to the edge of the ground plate and comprising:

a radiation plate disposed parallel to the surface of the ground plate;

a radiation strip disposed on at least one of a plurality of sides of the radiation plate so that a gap is formed between the radiation strip and the radiation plate; and a line connector extending from the edge of the ground plate in a direction perpendicular to the surface of the ground plate and connected to the radiation strip.

2. The Multi-Band antenna as claimed in claim 1, wherein the plurality of radiators is disposed such that electromagnetic waves radiated from the plurality of radiators are orthogonally polarized.

3. The Multi-Band antenna as claimed in claim 1, wherein each of the plurality of radiators further comprises:

a connector that is disposed in the gap between the radiation plate and the radiation strip and connects the radiation plate to the radiation strip.

4. The Multi-Band antenna as claimed in claim 1, wherein:

the radiation plate has a polygonal shape; and the radiation strip is disposed along the plurality of sides of the radiation plate and is folded at vertices of the radiation plate to form the gap between the radiation plate and the radiation strip.

5. The Multi-Band antenna as claimed in claim 1, wherein the radiation strip is inclined at approximately 45° to a plane perpendicular to the edge of the ground plate.

6. The Multi-Band antenna as claimed in claim 1, wherein the radiation plates of the plurality of radiators do not face each other.

7. The Multi-Band antenna as claimed in claim 1, wherein:

the radiation plate has a polygonal shape; and the radiation strip surrounds edges of the radiation plate facing away from the ground plate to form the gap between the radiation plate and the radiation strip.

8. The Multi-Band antenna as claimed in claim 1, wherein:

the radiation plate has a polygonal shape; and the radiation strip is folded at vertices of the radiation plate to form the gap between the radiation plate and the radiation strip.

9. A Multi-Band antenna system comprising:

an antenna configured to resonate in a plurality of frequency bands, the antenna comprising a plurality of radiators, the plurality of radiators having a disposition which is above the ground plate, each of the plurality of radiators comprising:

a radiation plate disposed in parallel to a surface of the ground plate;

a radiation strip disposed on at least one of a plurality of sides of the radiation plate so that a gap is formed between the radiation strip and the radiation plate; and a line connector extending from an edge of the ground plate in a direction perpendicular to the surface of the ground plate and connected to the radiation strip; and a controller configured to control the antenna, wherein the plurality of radiators is formed on opposing sides of the ground plate in directions perpendicular to the surface of the ground plate in a space at the edge of the ground plate, and is connected to the edge of the ground plate.

10. The Multi-Band antenna system as claimed in claim 9, wherein the controller is configured to control electric currents applied to the plurality of radiators to flow in opposite directions.

11. The Multi-Band antenna system as claimed in claim 9, wherein each of the plurality of radiators further comprises a connector disposed in the gap between the radiation plate and the radiation strip.

12. The Multi-Band antenna system as claimed in claim 11, wherein the controller is configured to:

control the antenna to resonate in a first frequency band by the radiation strip and the radiation plate;

resonate in a second frequency band by the radiation plate; and resonate in a third frequency band by coupling produced in the gap between the radiation plate and the radiation strip.

13. The Multi-Band antenna system as claimed in claim 9, wherein the controller is configured to control the plurality of radiators to alternately resonate.

14. An antenna comprising:

a ground unit;

a first radiator formed on the ground unit; and a second radiator formed on the ground unit, the second radiator comprising:

a radiation plate disposed parallel to a surface of the ground unit;

a radiation strip disposed on a side of the radiation plate so that a gap is formed between the radiation strip and the radiation plate; and a line connector extending from an edge of the ground unit in a direction perpendicular to the surface of the ground unit and connected to the radiation strip, wherein the first radiator and the second radiator are formed on opposing sides of the ground unit in directions perpendicular to the surface of the ground unit.

15. The antenna as claimed in claim 14, wherein the first and second radiators are of different size.

16. The antenna as claimed in claim 14, wherein the second radiator further comprises a connector formed in the gap between the radiation plate and the radiation strip to connect the radiation plate to the radiation strip.

* * * * *